US009670663B2

(12) United States Patent
Bradford et al.

(10) Patent No.: US 9,670,663 B2
(45) Date of Patent: Jun. 6, 2017

(54) COVER PANEL SEISMIC EXPANSION JOINT

(71) Applicant: WATSON BOWMAN ACME CORPORATION, Amherst, NY (US)

(72) Inventors: Paul Bradford, West Falls, NY (US); Gary Moore, Orchard Park, NY (US); Scott McFadden, Williamsville, NY (US)

(73) Assignee: Watson Bowman Acme Corporation, Amherst, NY (US)

( * ) Notice: Subject to any disclaimer, the term of this patent is extended or adjusted under 35 U.S.C. 154(b) by 0 days.

(21) Appl. No.: 15/012,534

(22) Filed: Feb. 1, 2016

(65) Prior Publication Data

US 2016/0145856 A1 May 26, 2016

Related U.S. Application Data

(63) Continuation-in-part of application No. 14/644,312, filed on Mar. 11, 2015, now Pat. No. 9,279,248.

(60) Provisional application No. 61/951,104, filed on Mar. 11, 2014.

(51) Int. Cl.
*E04B 1/68* (2006.01)
*E04F 13/08* (2006.01)

(52) U.S. Cl.
CPC ..... *E04B 1/6803* (2013.01); *E04B 1/68* (2013.01); *E04B 1/681* (2013.01); *E04F 13/0851* (2013.01)

(58) Field of Classification Search
CPC ..... E01B 1/68; E01B 1/6803
See application file for complete search history.

(56) References Cited

U.S. PATENT DOCUMENTS 1,357,713 A * 11/1920 Lane ..... E04B 1/6803 404/69
3,394,639 A * 7/1968 Viehmann ..... E01C 11/126 404/47
3,435,574 A 4/1969 Hallock
3,659,390 A * 5/1972 Balzer ..... E04B 1/6804 404/69
3,696,575 A 10/1972 Armstrong
5,060,439 A * 10/1991 Clements ..... E04B 1/6815 404/47

(Continued)

*Primary Examiner* — Andrew J Triggs
(74) *Attorney, Agent, or Firm* — Curatolo Sidoti Co., LPA; Salvatore A. Sidoti; Peter J. Beardsley

(57) ABSTRACT

A seismic expansion joint cover assembly installed at an expansion gap between a first structural member on one side of a gap and a second structural member on the opposite side of the gap including a cover panel bridging the gap having at least one connector joining one edge of the cover panel to the first structural component to allow movement of the cover panel. The expansion joint cover assembly includes at least one slide support, which attaches to the second structural member, and which includes a track having a lift component located on the track to lift the cover panel. The expansion joint cover assembly also includes a rider assembly for engaging with the track of the slide support. One or more spring assemblies are attached to the second structural member and the cover panel. The expansion joint cover assembly is mechanically latched when the system is in the normal service position, but has the capability of becoming unlatched in response to large displacements.

16 Claims, 17 Drawing Sheets

(56) References Cited

U.S. PATENT DOCUMENTS

| | | | | |
|---|---|---|---|---|
| 5,067,297 | A * | 11/1991 | Sobol | E04B 1/6815 404/56 |
| 5,319,907 | A | 6/1994 | Nicholas et al. | |
| 5,829,216 | A | 11/1998 | Newcomb et al. | |
| 6,014,848 | A | 1/2000 | Hilburn, Jr. | |
| 6,430,884 | B1 | 8/2002 | Shreiner et al. | |
| 6,499,265 | B2 * | 12/2002 | Shreiner | E04B 1/681 404/68 |
| 8,267,617 | B2 | 9/2012 | Bradford et al. | |
| 8,454,264 | B2 * | 6/2013 | Bradford | E01D 19/065 404/47 |
| 2002/0032997 | A1 * | 3/2002 | Shreiner | E01D 19/06 52/393 |
| 2010/0263312 | A1 * | 10/2010 | Bradford | E01D 19/065 52/309.17 |
| 2015/0259901 | A1 | 9/2015 | Bradford | |

* cited by examiner

COVER PANEL SEISMIC EXPANSION JOINT

CROSS-REFERENCE TO RELATED APPLICATIONS

The present application is a continuation-in-part of U.S. Ser. No. 14/644,312, filed Mar. 11, 2015, which claims the benefit of the filing date under 35 U.S.C. §119(e) of U.S. Provisional Application For Patent Ser. No. 61/951,104, filed Mar. 11, 2014, both of which are hereby incorporated by reference in their entireties.

TECHNICAL FIELD

The present disclosure relates to a device for supporting facades used on a structure, where the facade may be subject to movement relative to the supporting structure.

BACKGROUND

The use of facades in the construction industry enhances the aesthetic appearance of a structure and may provide thermal and sound insulation to the interior of the structure, rather than functioning as a load bearing member. The term "facades," as used herein, refers to panels or structural units attached to the exterior of an architectural structure or building, and the facade may be made of stone, masonry, glass, metal or other materials or combinations of such materials.

Such structures include wall expansion joints to accommodate displacements due to thermal expansion, wind loads, and earthquake (seismic) movements. Generally seismic displacements caused by earthquakes can be much larger than displacements caused under normal daily loads or moderate wind loads. Seismic displacements require a device which supports a facade for translational and/or pivotal movement relative to the supporting building structure. An expansion joint system designed to meet such displacements is highly desirable and not adequately addressed in the prior art.

SUMMARY

Provided is a support for mounting a facade to a building to provide increased resistance to seismic disturbance. According to illustrative embodiments, the support system may permit both limited translational and pivotal movement. The capability of permitting translational and pivotal movements minimizes the effect of building movement on the facade and its supports when the building oscillates in unpredictable patterns as a result of e.g., slip, strike-slip, oblique slip or separation type faults.

The seismic expansion joint cover assembly comprises a cover panel that bridges an expansion gap between structural members of a building or other structure such as a stadium, parking deck, or other architectural structure. The structural member, by way of non-limiting example, may be a wall or beam. The expansion joint cover is a cover panel including a coupler such as a hinge for connecting one side of the cover to an edge of a structural member on one side of the expansion gap. The underside of the cover panel rides on slide supports and optionally angle supports, attached to a structural member on the opposite side of the expansion gap bridged by the cover panel. According to certain illustrative embodiments, multiple slide supports and angle supports may be utilized depending on the size of the cover panel.

According to certain embodiments, the slide support includes a flange and a track having a top surface and a bottom surface, and said track extends along an axis generally perpendicular to the flange. The flange attaches the slide support to the structure. The slide support further includes a wedge-shaped lift component having a sloped incline that may be along a straight or curved line. The lift component is located along the track to engage and lift the exterior panel when the panel or building moves. The support further includes a downwardly extending protrusion functional as a stop member to limit forward movement, located on the longitudinal track a distance from the flange. In one embodiment, the stop component is located at the end of the track opposite the flange. The slide support engages a spring assembly. The spring assembly includes a spring plate and one or more springs integral with said spring plate. The spring plate attaches to the underside of the cover panel. The spring plate also includes a guide component integral therewith or attached thereto, and a saddle component that engages the bottom surface of the track. The saddle component has a proximal groove to engage the track and a distal groove or opening to engage the springs and hold them in place during movement.

Opening of the expansion joint is facilitated by the spring assembly attached to the cover panel. As the joint opens, the guide slides along the slide track and up the lift, and the panel swings or pivots into a partially open position. This prevents the panel from hitting an adjacent fixed wall panel on the structure.

Closing of the expansion joint is facilitated by the guide sliding on the slide track in the opposite direction until the stop component engages the spring assembly saddle and prevents it from disengaging from the slide track. The spring(s) in the spring assembly stretches to prevent the panel from excessive pivoting.

Angle brackets or supports, configured to form a 90 degree angle and comprising an appropriate metal or polymeric material may also be attached to the structural member at various locations to provide additional support to the cover panel. In one embodiment, the angle bracket may comprise two members at 90 degrees to each other, in another embodiment the bracket may be configured as a right isosceles triangle having three members. One member of the angle bracket is attached to the structural component and the cover panel moves slidably across the angle support when the expansion joint cover assembly is activated.

According to an illustrative embodiment, the expansion joint system comprises a cover assembly installed at an expansion gap between a first structural member on one side of the expansion gap and a second structural member on the opposite side of the expansion gap. The cover assembly comprises a cover panel having a top side and an underside. The cover panel bridges the expansion joint gap. The system includes at least one moveable connector for joining one edge of the cover panel to the first structural member. The system also includes at least one slide support attached to the second structural member. The at least one slide support comprises a top surface, a bottom surface, spaced-apart side walls, a front end, a rear end, a track extending along the top surface of the slide support from the front end to the rear end of the slide support. The track has a lift component located on the track adjacent to the rear end of the slide support. The slide support also includes a protrusion extending substantially perpendicular from one of the side walls of said slide support and that is located at a distance from the rear end of the slide support. A rider assembly is attached to the underside of the cover panel for engaging with the slide support.

The rider assembly comprises a base, a mounting extending substantially perpendicular to the base, a rotatable wheel mounted on one side of the mounting and a guide extending perpendicular from the opposite side of the mounting to engage the protrusion of the slide support. At least one slide spring assembly is attached to the second structural member. The slide spring assembly comprises a spring plate connected to the second structural member, at least one arm extending outwardly from the spring plate into the expansion gap, a rotatable member engaged with the at least one arm, and a spring having opposite ends. One end of the spring is engaged with the rotatable member and the opposite end of the spring is engaged with the cover panel.

According to an illustrative embodiment, the expansion joint system comprises spaced-apart first and second structural members and having an expansion joint gap between the first and second structural members. The expansion joint system includes a cover assembly comprises a cover panel having a top side and an underside. The cover panel bridges the expansion joint gap. The system includes at least one moveable connector for joining one edge of the cover panel to the first structural member. The system also includes at least one slide support attached to the second structural member. The at least one slide support comprises a top surface, a bottom surface, spaced-apart side walls, a front end, a rear end, a track extending along the top surface of the slide support from the front end to the rear end of the slide support. The track has a lift component located on the track adjacent to the rear end of the slide support. The slide support also includes a protrusion extending substantially perpendicular from one of the side walls of said slide support and that is located at a distance from the rear end of the slide support. A rider assembly is attached to the underside of the cover panel for engaging with the slide support. The rider assembly comprises a base, a mounting extending substantially perpendicular to the base, a rotatable wheel mounted on one side of the mounting and a guide extending perpendicular from the opposite side of the mounting to engage the protrusion of the slide support. At least one slide spring assembly is attached to the second structural member. The slide spring assembly comprises a spring plate connected to the second structural member, at least one arm extending outwardly from the spring plate into the expansion gap, a rotatable member engaged with the at least one arm, and a spring having opposite ends. One end of the spring is engaged with the rotatable member and the opposite end of the spring is engaged with the cover panel.

According to certain illustrative embodiments, a vertical wall construction is provided. The vertical wall comprises spaced-apart, vertically extending first and second structural members and having an expansion joint gap between the first and second structural members. The expansion joint system is installed across the expansion joint gap between the structural members. The expansion joint system includes a cover assembly comprises a cover panel having a top side and an underside. The cover panel bridges the expansion joint gap. The system includes at least one moveable connector for joining one edge of the cover panel to the first structural member. The system also includes at least one slide support attached to the second structural member. The at least one slide support comprises a top surface, a bottom surface, spaced-apart side walls, a front end, a rear end, a track extending along the top surface of the slide support from the front end to the rear end of the slide support. The track has a lift component located on the track adjacent to the rear end of the slide support. The slide support also includes a protrusion extending substantially perpendicular from one of the side walls of said slide support and that is located at a distance from the rear end of the slide support. A rider assembly is attached to the underside of the cover panel for engaging with the slide support. The rider assembly comprises a base, a mounting extending substantially perpendicular to the base, a rotatable wheel mounted on one side of the mounting and a guide extending perpendicular from the opposite side of the mounting to engage the protrusion of the slide support. At least one slide spring assembly is attached to the second structural member. The slide spring assembly comprises a spring plate connected to the second structural member, at least one arm extending outwardly from the spring plate into the expansion gap, a rotatable member engaged with the at least one arm, and a spring having opposite ends. One end of the spring is engaged with the rotatable member and the opposite end of the spring is engaged with the cover panel.

The present system is useful as an expansion joint where seismic movement is not a consideration, as well as for the above described seismic expansion joint for cover panels on a structure.

For a better understanding of the invention, reference may be made to the following description of exemplary embodiments, taken in conjunction with the accompanying drawings.

DETAILED DESCRIPTION OF ILLUSTRATIVE EMBODIMENTS

Figure 1:
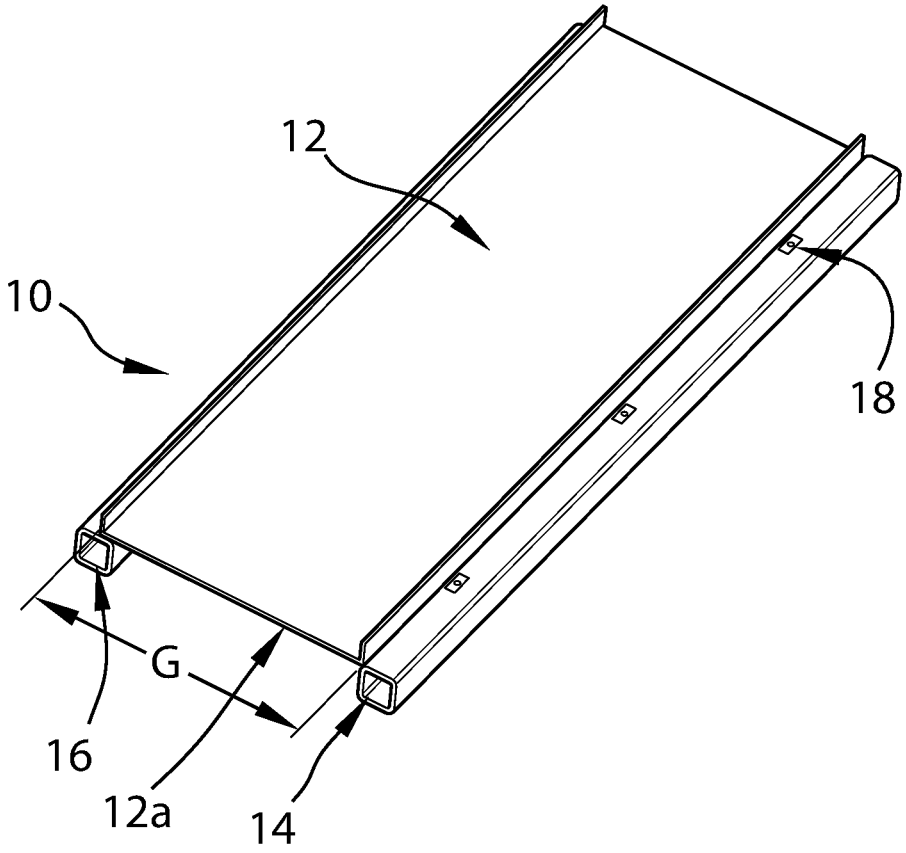
FIG. 1 is a top plan view of an embodiment of an exterior cover panel.

Provided is a seismic expansion joint cover assembly for mounting a facade to a building to allow a facade to move during high winds or a seismic disturbance and provides increased resistance to damage from a seismic disturbance. As shown in FIG. 1, the seismic expansion joint cover assembly 10 is installed at an expansion gap between a first structural member 14 on one side of a gap G and a second structural member 16 on the opposite side of the gap. The cover assembly includes a cover panel 12 that bridges the expansion gap between an edge of the first structural member 14 to which it attaches on one side of the gap and the second structural member 16 on the opposite side of the gap. The structural members are structural members of a building, stadium, parking deck or other architectural structure, and can be any suitable structural member to which an exterior panel may be attached, where non-limiting examples of the structural member include a wall, a beam, or a roof.

Figure 2:
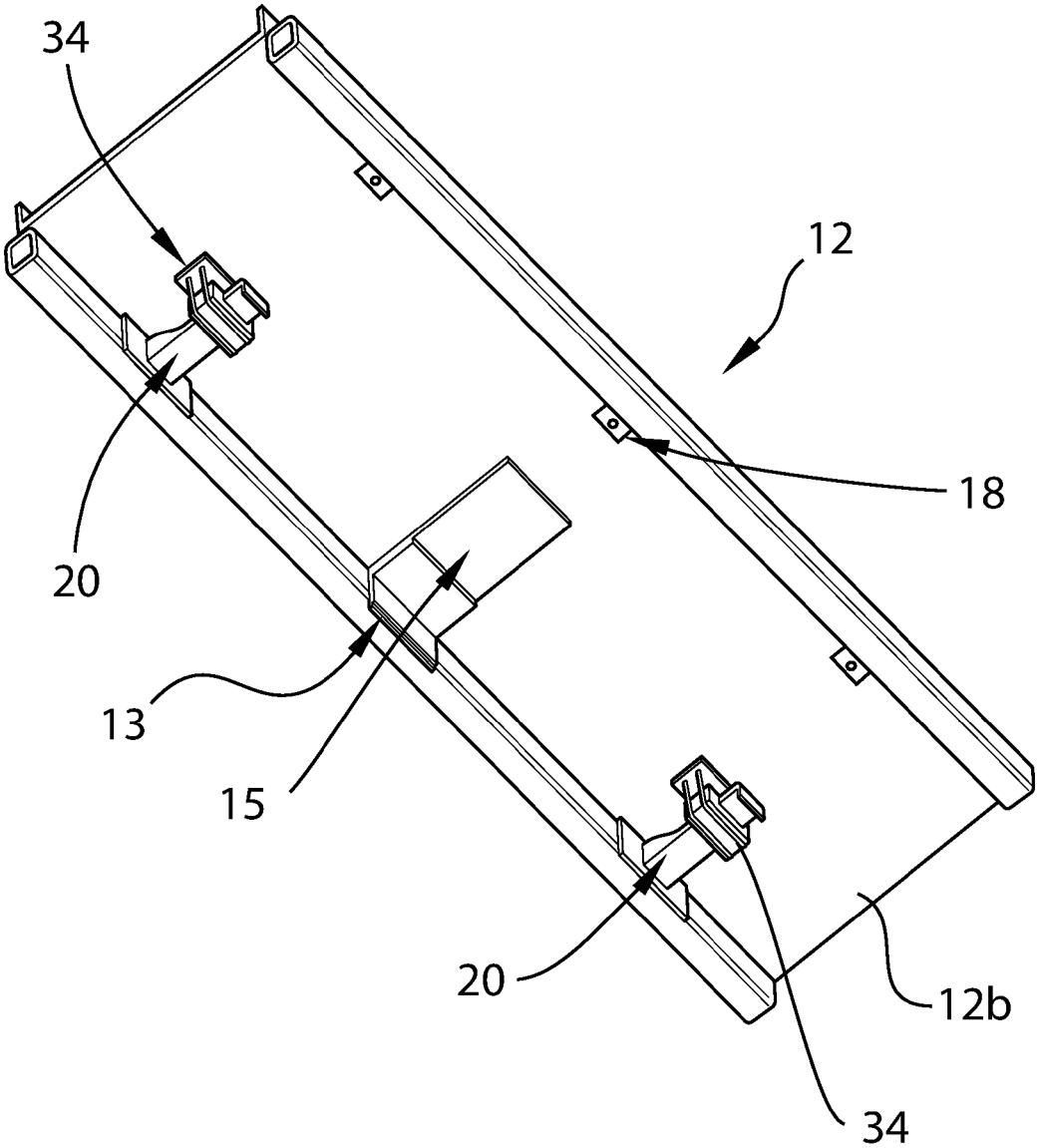
FIG. 2 is a bottom plan view of an exterior cover panel.
Figure 6:
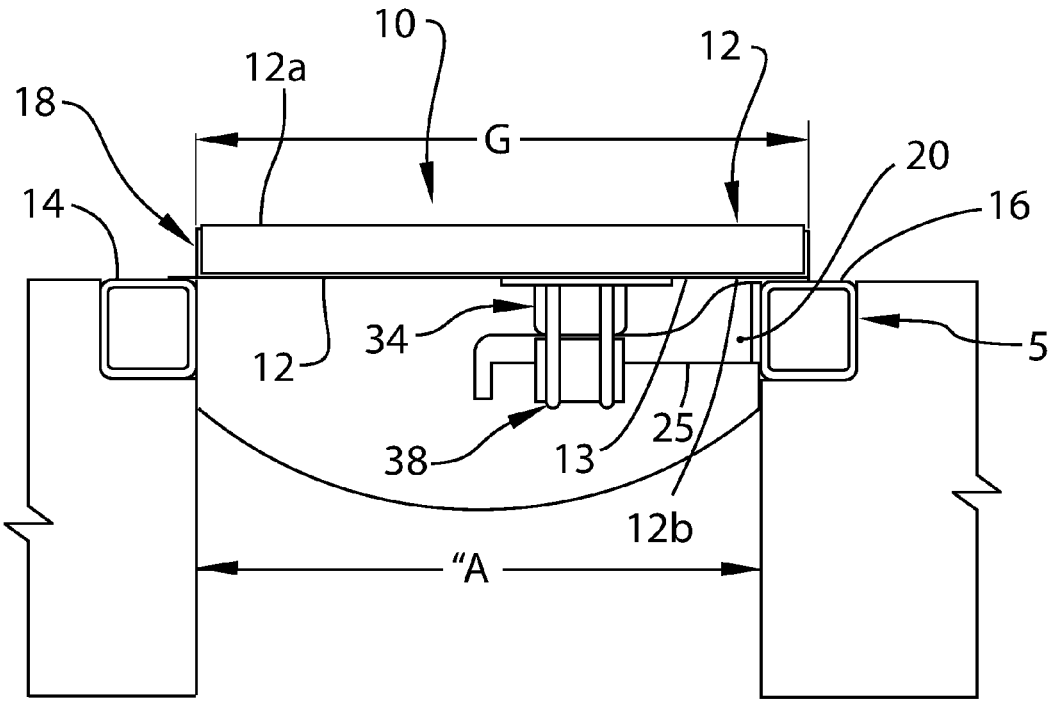
FIG. 6 is a perspective view of an installed expansion joint.

FIG. 1 illustrates an embodiment of the expansion joint cover assembly 10 including at least one moveable connector 18 that is connected to the structural member 14 and to the cover panel 12. The invention may be configured so that the moveable connector 18 may be attached to either structural member 14 or 16. FIG. 1 illustrates one embodiment of the invention. The moveable connector 18 in one embodiment is a pivoting connector joining the cover panel 12 to the structural member 14 to allow pivotal movement of the cover panel 12 about a pivot axis when the structure is subjected to seismic or other movement. The moveable connector 18, is pivotable about an axis and allows the cover panel to pivot is, in one embodiment, a hinge. The cover panel includes a top side 12*a* as shown in FIG. 1, and an underside 12*b*, as shown in FIG. 2. As shown in FIG. 2, the underside of the cover panel 12*b* slides on at least one slide support 20. As shown in FIG. 6, the slide support 20 is attached to a structural member 16. The slide support is attached to the structural member without the pivoting connector.

Figure 4:
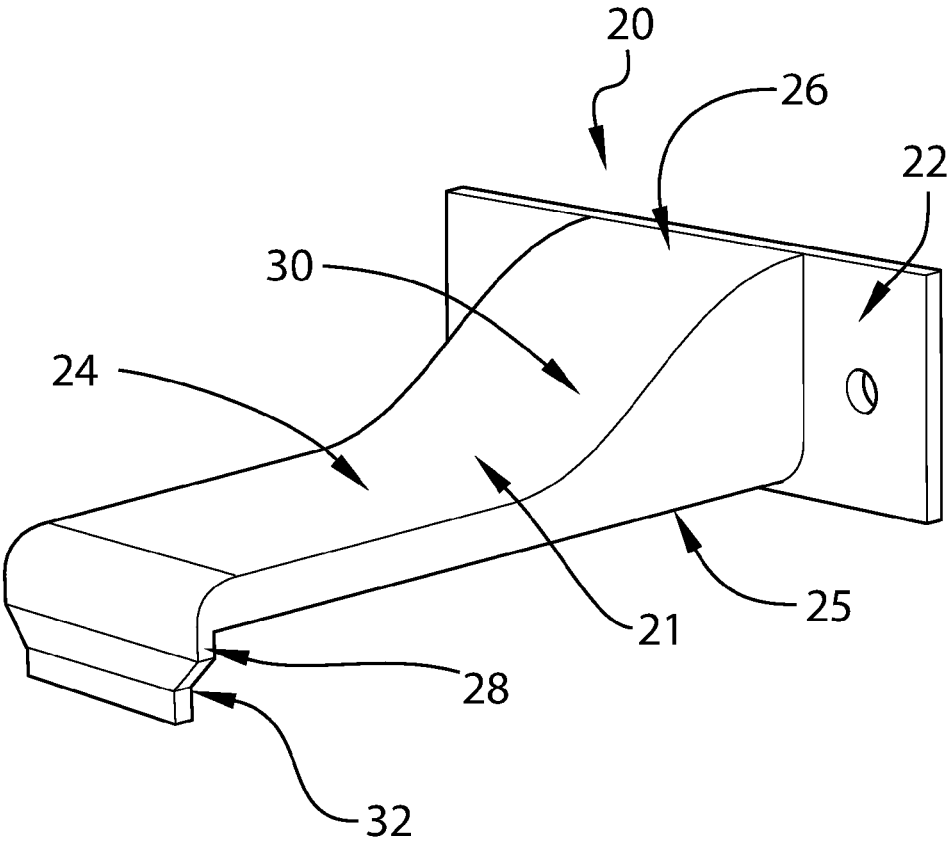
FIG. 4 is a detailed view of a slide assembly.

FIG. 4 illustrates a slide support 20, having a top side 21 and a bottom side 25, and including a flange 22 for attaching the slide support to a structural member, and a slide track 24 extending generally perpendicular to the flange, the flange having a flange end 26 and a stop end 28. The flange end of the slide support is located where the slide track 24 meets the flange 22, and the stop end is located at the end of the slide opposite the flange end. The slide track may be integral with the flange or removably attached thereto. The flange 22, in one embodiment, is attached to a structural member, for example, by means of fasteners or, in an alternative embodiment is welded to the structural member. The slide support further includes a lift component 30, (hereinafter lift), located on, or integral with the slide track 24. The lift component is generally wedge-shaped and has a sloped incline surface that may be along a straight or curved line, where the cover panel contacts the sloped incline to assist in lifting a cover panel during movement of the building and/or the panels. The wedge-shaped lift is located at the end closest to the flange end of the slide track. The slide track may be comprised of aluminum, or other suitable metal or polymer. The slide track in one embodiment is formed from aluminum and the wedge-shaped lift is integral with the slide Alternatively the lift may be formed separately from the slide track, and may be removably attached to the slide track with fasteners, or permanently affixed by welding or other appropriate means. The angle of the lift may be varied depending on the degree of pivot and/or translational movement desired. The slide support 20 further includes a stop component 32 located at the stop end 28 of the track opposite the flange. The stop component in one embodiment is a lip or protrusion extending in a direction that is downward from the underside of the cover panel. As shown in FIG. 6, the slide support engages with a spring assembly 34 to allow translational movement or pivoting of the cover panel when seismic, weather or other disturbances occur to cause movement of the building or cover panels.

Figure 5:
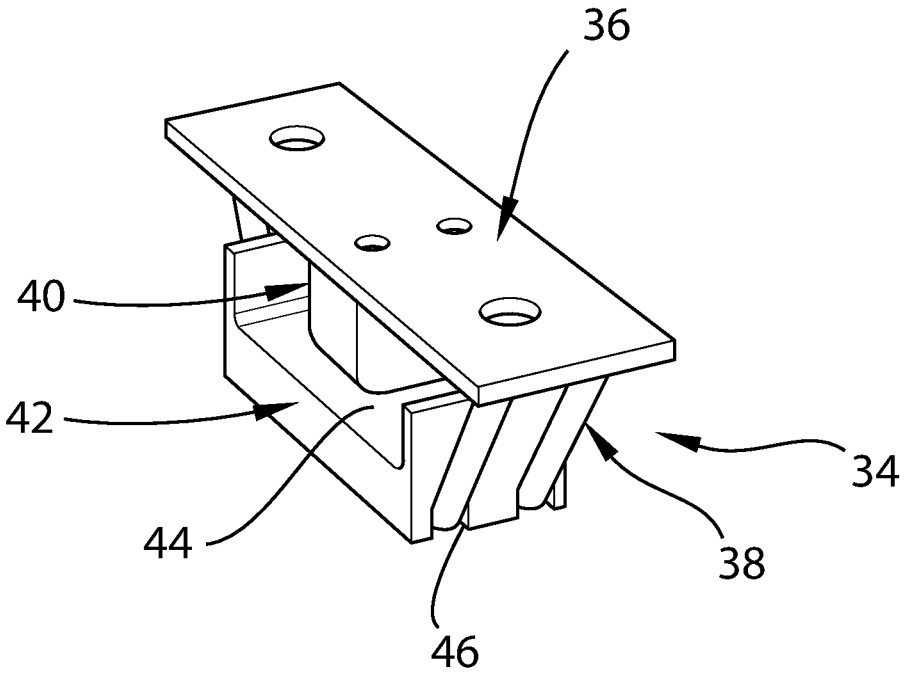
FIG. 5 is a detailed view of a spring assembly.

As shown in FIG. 5, the spring assembly 34 includes a spring plate 36 for mounting the assembly to a cover panel (not shown), and one or more springs 38 integral with or attached to said spring plate. In one embodiment steel coil springs are used and are integral with the spring plate. The springs may be of any suitable material of adequate strength for the desired application. In one embodiment, the spring plate is removably attached to the underside of the cover panel. Alternatively the spring plate may be permanently affixed to the cover panel by welding or other suitable methods. The spring plate also includes a guide component 40, integral therewith or attached thereto, for guiding movement along the slide track 24. During opening and closing of the of the expansion joint, the guide 40 slides over the top surface 21 of the slide track, which is the surface facing the underside of the cover panel 12*b*.

The spring assembly further includes a saddle component 42. As shown in FIG. 6, the saddle component engages the bottom side of the slide track 25, where the bottom side is the side of the track that faces away from the underside of the cover panel 12*b*. As shown in FIG. 5, the saddle 42 includes a proximal groove or recess 44, to engage the bottom side of the slide, and a distal groove or recess or opening 46 to engage the springs 38 and hold them in place. The stop 32 located on the slide track 24 engages the saddle 42 to prevent it from moving off the slide when expansion joint closes. The guide may move beyond the slide track, but returns to the slide track by retraction of the springs 38 to which it is attached. In one embodiment, the saddle and guide are comprised of a nylon polymer. Other suitable materials, preferably polymeric, may be used for these components.

In one embodiment the invention provides an expansion joint system which includes the seismic expansion joint cover assembly installed at an expansion gap between a first structural member on one side of a gap and a second structural member on the opposite side of a gap as described hereinabove.

Figure 3:
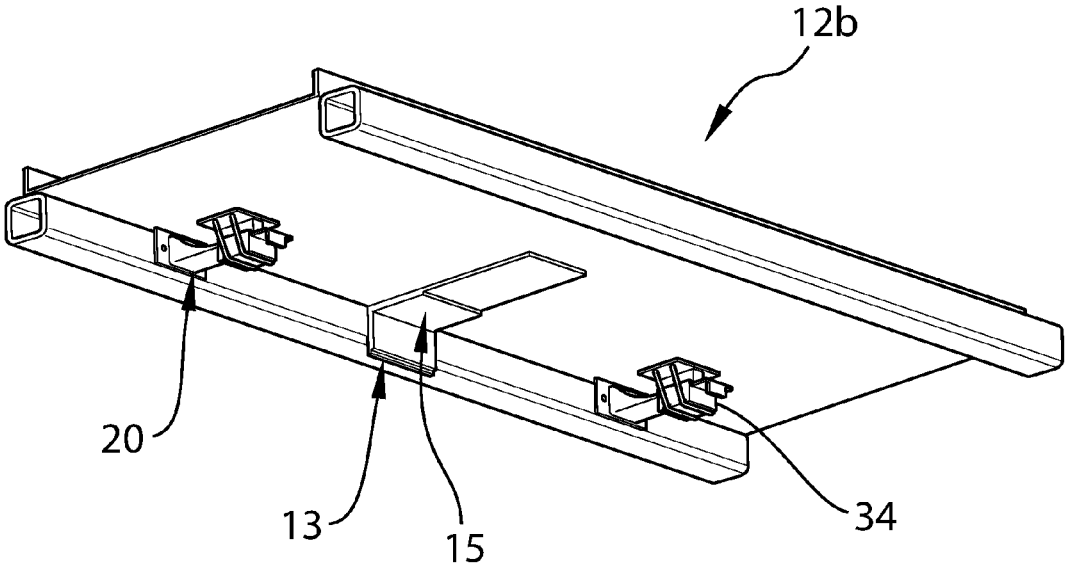
FIG. 3 is a bottom plan view of an exterior cover panel.

In embodiments shown in FIGS. 2 and 3, the expansion joint system includes an expansion cover panel 12 having one or more grooves or recesses 13 having a determined length and width, formed in the underside of the cover panel to movably or slidably receive one or more shelf supports which are angle brackets 15 with a width slightly less than that of the receiving groove or recess, where the angle bracket is attached to the structural member. The cover panel grooves 13 slidably engage one or more angle brackets 15 while the spring assembly 34 is engaged and the cover panel pivots or moves as the cover panel returns to its original position. The angle brackets are typically right angle brackets having two members at right angles to each other. In another embodiment the bracket may be configured as a right isosceles triangle having three members. One member of the bracket is attached to a structural member on the side of the gap to which the slide member is attached. The member orthogonal to the structural member provides a surface that is in contact with the cover panel grooves which slidably engage the angle support when the expansion joint cover assembly is activated. In another embodiment, the cover panel slides over the three-membered isosceles triangle brackets which do not engage the grooves in the cover panel and the two membered angle brackets slide in the grooves of the cover panel.

In an alternative embodiment additional angle supports may be provided which slidably engage the cover panel and do not engage the grooves in the cover panel. In yet another alternative embodiment, the cover panel does not have grooves to receive angle supports, and the cover panel slidably engages the angle supports during operation of the expansion joint cover assembly.

Opening of the expansion joint cover assembly 10 is facilitated by the spring assembly 34 attached to the cover panel 12. As an expansion joint opens, the guide component 40 of the spring assembly slides along the slide track 24 toward and up the lift 30, and the panel swings or pivots into a partially open position. This prevents the panel from hitting an adjacent fixed cover panel on the structure.

Closing of the expansion joint cover assembly is facilitated by the guide component 40 sliding in the track 24 in the direction away from the lift 30, until the stop component 32 engages the spring assembly saddle 42 and prevents it detaching from the track. The spring 38 in the spring assembly 34 stretches to provide tension on the cover panel to prevent the panel from pivoting excessively.

Figure 7:
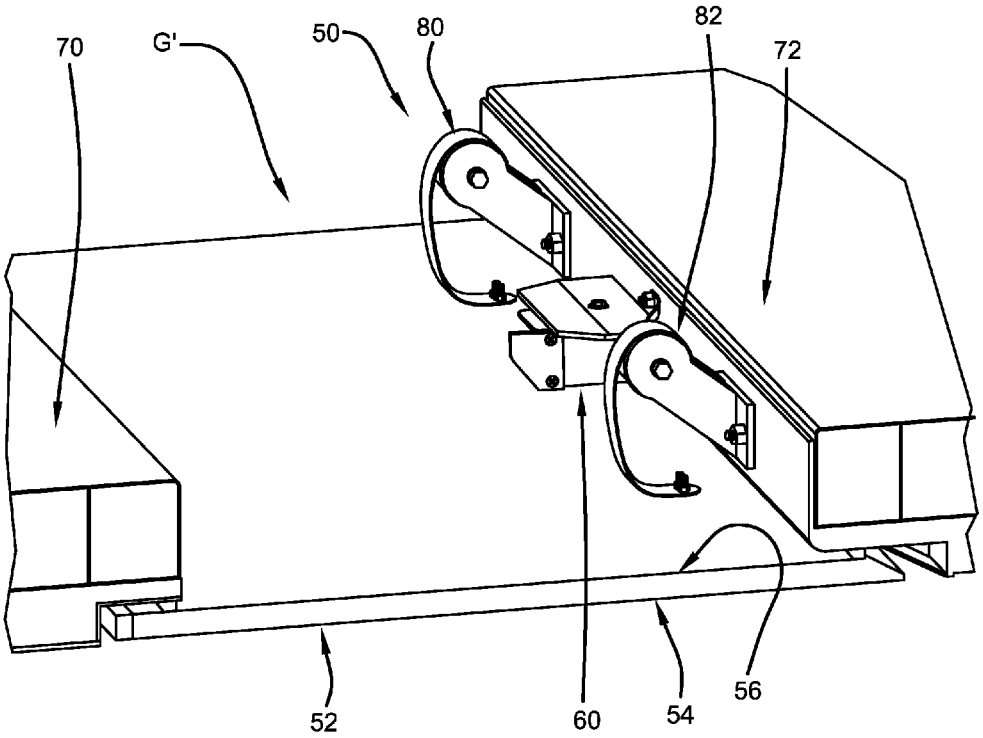
FIG. 7 is a perspective view of the underside of an illustrative embodiment of the cover panel expansion joint system.

In the illustrative embodiment shown in FIG. 7, the cover panel expansion joint system 50 includes an expansion cover panel 52 that spans the expansion gap G' located between spaced-apart structural members 70, 72. The cover panel 50 includes top side 54 and underside 56. The cover panel 52 slides on at least one slide support 60. Spring assemblies 80, 82 are positioned on the same side of the expansion joint gap G' as the slide support 60 and flank both sides of the slide support 60.

Figure 8:
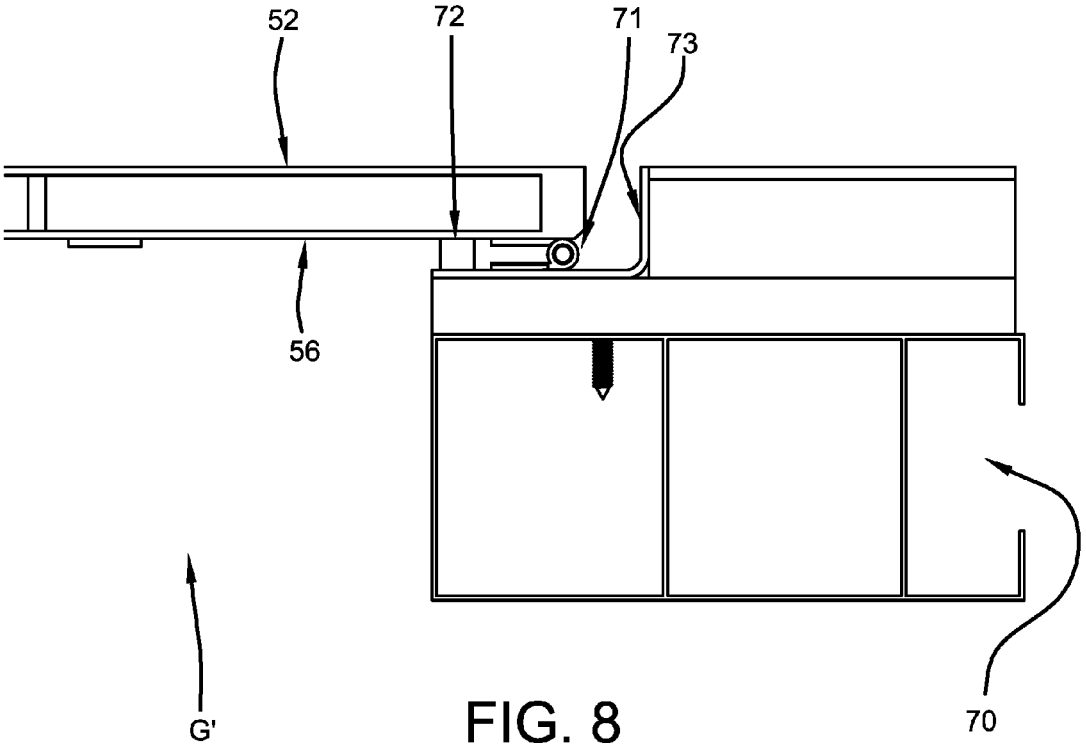
FIG. 8 is a partial side view of one side of the cover panel expansion joint assembly positioned within an expansion joint gap.

FIG. 8 is partial side view of one side of the cover panel expansion joint assembly 50 positioned within an expansion joint gap G'. The cover panel expansion joint system 50 includes a first structural member 70. Cover panel 52 is connected to first structural member 70 through a connector member 71. Without limitation, and only by way of illustration, connecting member 71 comprises a hinge connector. The cover panel system 50 also includes a bearing member 72 that is positioned between the underside 56 of cover panel 52 and angle bracket 73. The sealing bearing 72 mitigates the infiltration of water and debris, and also prevents cover panel 52 from dropping downwardly into the expansion joint gap G' as the expansion joint opens.

Figure 9:
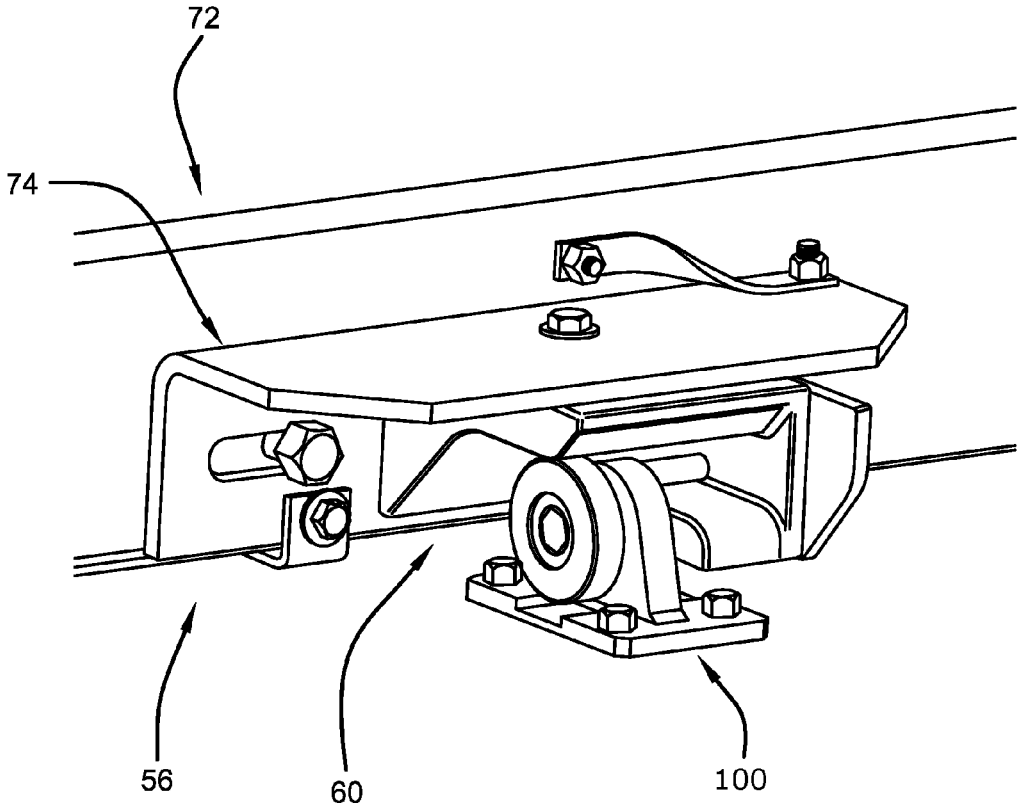
FIG. 9 is a perspective view of the slide support assembly of an illustrative embodiment of the cover panel expansion joint system.

As shown in FIG. 9, the slide support 60 is attached to structural member 72 by angle bracket member 74 and mechanical fasteners. Rider assembly 100 is attached to the underside 56 of cover panel 52 and is adapted to engage with slide support 60. The expansion joint cover assembly 50 is mechanically latched when the system is in the normal service position, but has the capability of becoming unlatched in response to large displacements.

Figure 10:
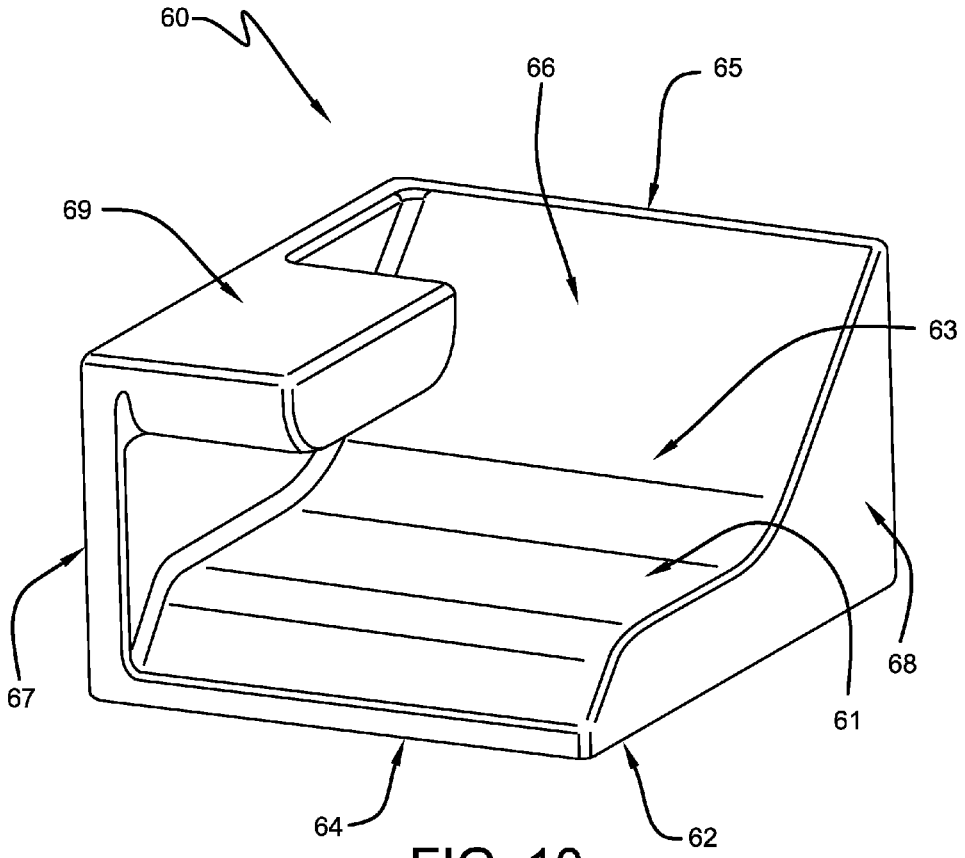
FIG. 10 is a perspective view of an illustrative embodiment of the slide support of the cover panel expansion joint system.

FIG. 10 depicts an illustrative embodiment of slide support 60. Slide support 60 includes a top side 61 and a bottom side 62. Slide support includes a slide track 63 extending from the front 64 to the rear 65 of the slide support. Slide support 60 includes side walls 67, 68 and a protrusion 69 extending outwardly from side wall 67 in a manner that is substantially perpendicular to side wall 67. The slide support 60 further includes a lift component 66 located on, or integral with, the slide track 63. The lift component 66 has a sloped incline surface that may be along a straight or curved line, and the sloped incline assists in lifting the cover panel 50 during movement of the building and/or the panels. The lift 66 is located on the slide track 63 at the rear end 65 of slide support 60.

The slide support 60 may be comprised of, for example, a metal, a metal alloy, a composite material, or polymer material. According to certain illustrative embodiments, and without limitation, the slide support 60 may be comprises of aluminum. The slide track 63 according to one illustrative embodiment is formed from aluminum and the wedge-shaped lift 66 is integral with the slide 63. According to alternative embodiments, the lift 66 may be formed separately from the slide track 63, and may be removably attached to the slide track 63 with fasteners, or permanently affixed by welding or other appropriate means. The angle of the lift 66 may be varied depending on the degree of pivot and/or translational movement desired. A nosing member may be attached to the slide support 60 in order to raise the cover panel 52 as it falls downwardly into the expansion joint gap as the expansion joint closes and after the expansion joint has fully opened.

Figure 11:
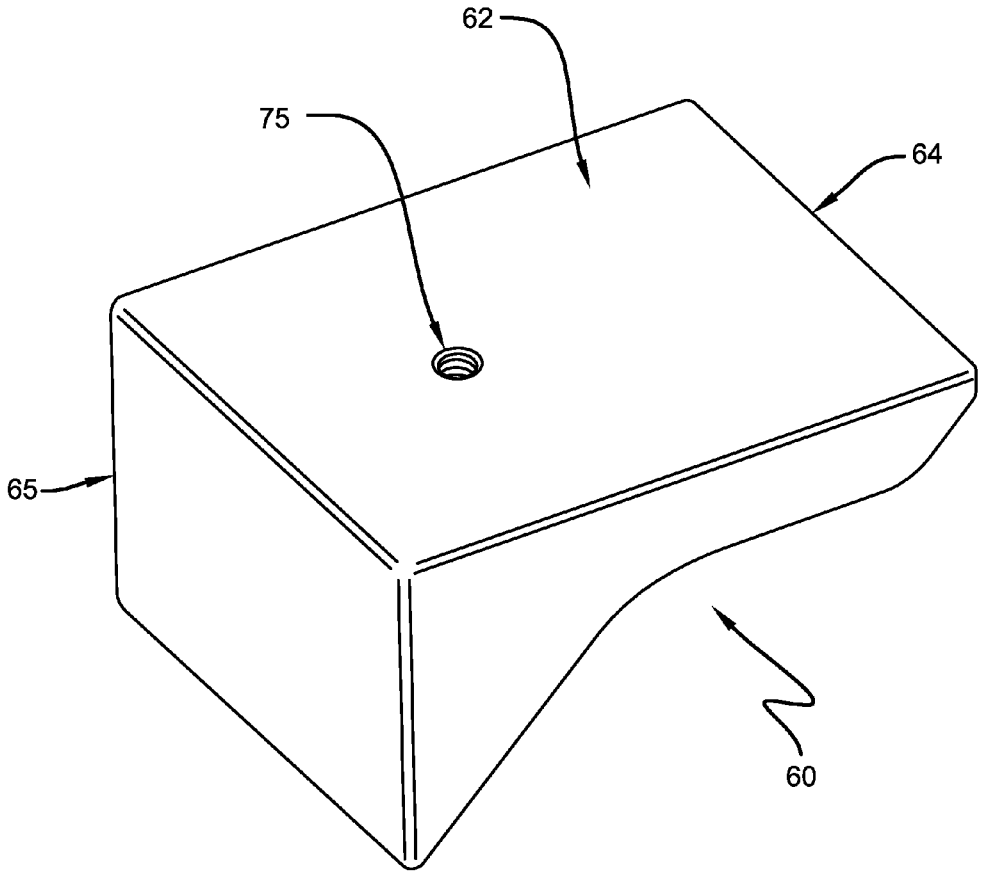
FIG. 11 is a bottom perspective view of an illustrative embodiment of the slide support of the cover panel expansion joint system.

FIG. 11 shows the bottom side 62 of illustrative slide support 60. Bottom side 62 of slide support 60 includes a counter-sunk threaded insert 75 to accept a threaded mechanical fastener for attaching the slide support 60 to the underside 56 of the cover panel 50. It should be noted that attachment of the slide support 60 to the cover panel 52 is not limited to mechanical fasteners. The slide support 60 may be attached or other affixed or connected to the underside 56 of the cover panel 52 via any suitable means, such as, without limitation, adhesives, welds and the like.

Figure 12:
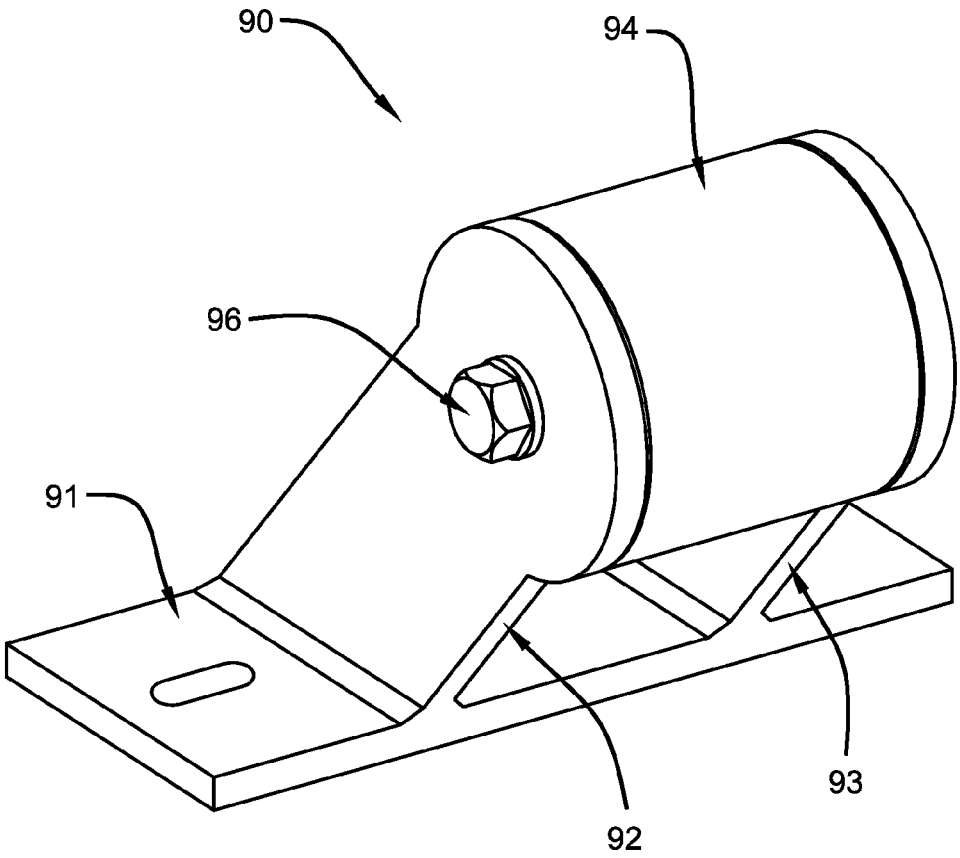
FIG. 12 is a perspective view of an illustrative embodiment of the spring assembly of the cover panel expansion joint system.

FIG. 12 shows an illustrative embodiment of the spring assembly 90 of the cover panel expansion joint system 50. Spring assembly 90 includes a base member or base plate 91 for attaching the assembly 90 to one of the spaced-apart structural members of the expansion joint of the building structure. Spring assembly 90 includes spaced-apart spring assembly arms 92, 93. Spring assembly arms 92, 93 extend outwardly from the surface of the base plate member 91 at an angle. Without limitation, the spring assembly arms 92, 93 extend outwardly from the surface of the base member 91 at substantially the same angle. The spring arms 92, 93 have opposite first and second ends, with the first ends being connected to the base member 91. The second ends of the spring assembly arms 92, 93 terminate in a rounded geometry. Spring assembly 90 also includes a rotatable member 94 that is positioned between the second rounded ends of the arms 92, 93. The rotatable member 94 is attached to spaced-apart arms 92, 93 by an elongated pin 95 and mechanical fasteners 96, 97. Rotatable member 94 is capable of rotating about an axis defined by the pin 95. In the embodiment shown in FIG. 12, the outer circumference of the rotatable member 94 is substantially the same as the outer circumferences of the second ends of spring arms 92, 93.

Figure 13:
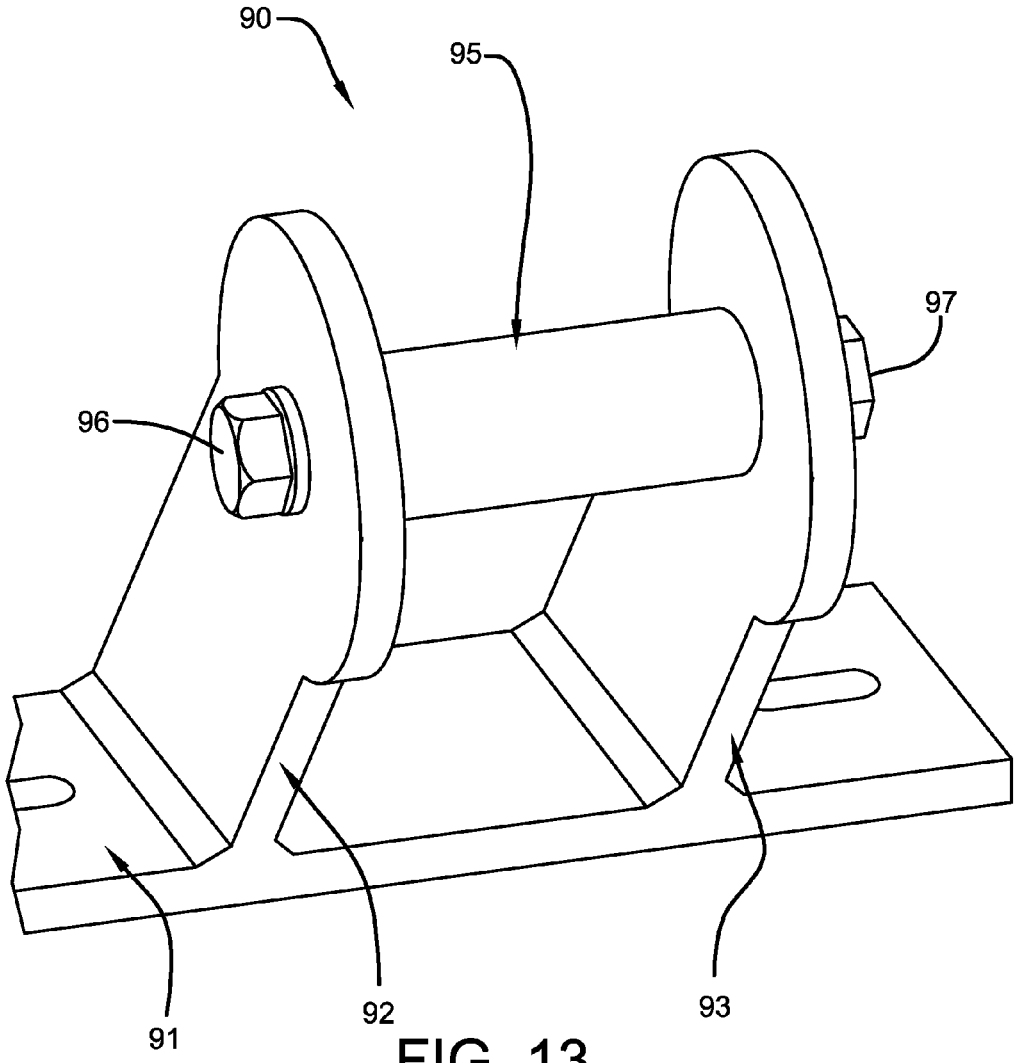
FIG. 13 is another perspective view of an illustrative embodiment of the spring assembly of the cover panel expansion joint system shown in FIG. 11.

FIG. 13 shows an illustrative embodiment of the spring assembly 90 of the cover panel expansion joint system 50 without rotatable member 94. Spring assembly 90 includes a base member 91 for attaching the assembly 90 to one of the spaced-apart structural members of the expansion joint of the building structure. Spring assembly 90 includes spaced-apart spring assembly arms 92, 93. Spring assembly arms 92, 93 extend outwardly from the surface of the base plate member 91 at an angle. The pin 95 for attaching the rotatable member 94 (not shown) to the spaced-apart arms 92, 93 is shown extending between the inner surfaces of the spaced-apart spring arms 92, 93.

Figure 14:
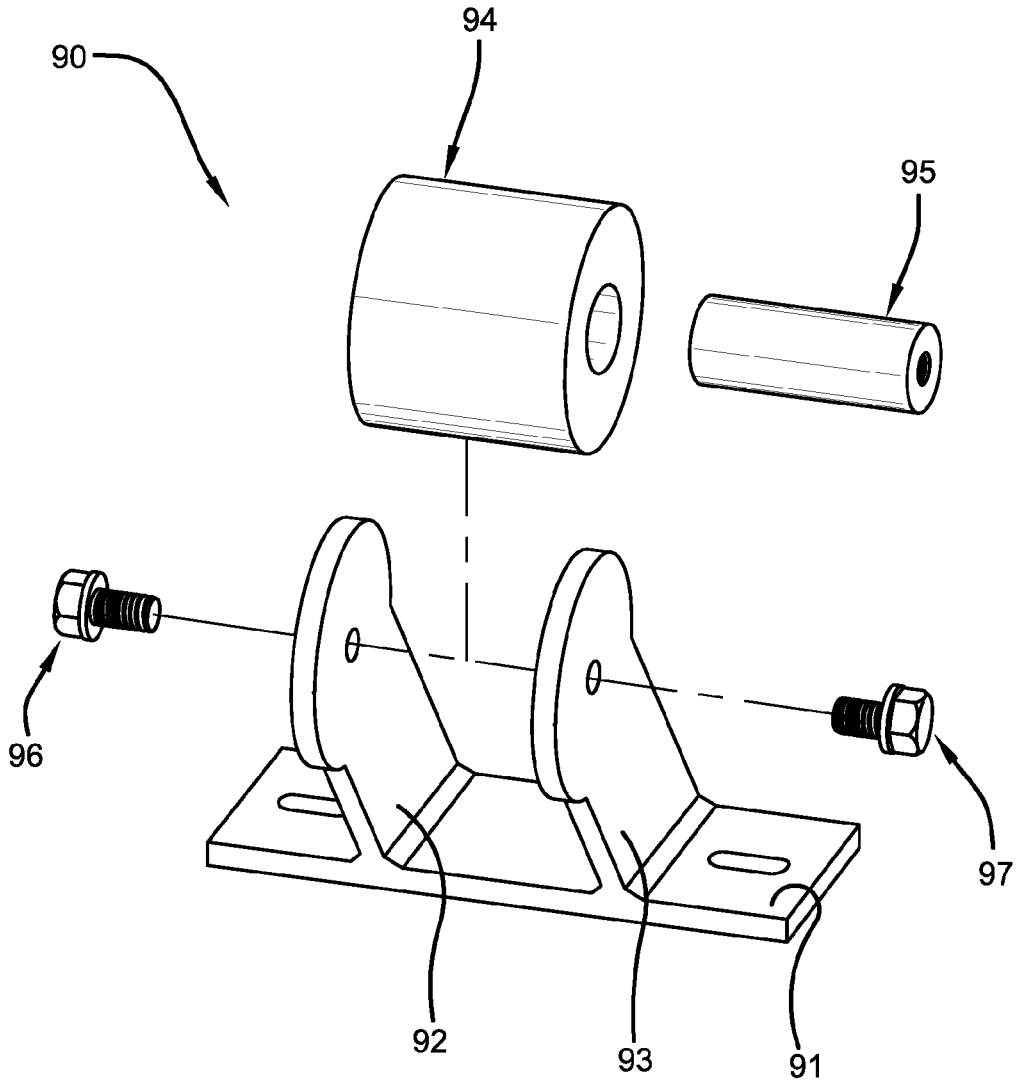
FIG. 14 is an exploded perspective view of an illustrative embodiment of the spring assembly of the cover panel expansion joint system shown in FIG. 12.

FIG. 14 is an exploded view of an illustrative embodiment of the spring assembly 90 of the cover panel expansion joint system 50. Spring assembly 90 includes a base member 91 for attaching the assembly 90 to one of the spaced-apart structural members of the expansion joint of the building structure. Spring assembly 90 includes spaced-apart spring assembly arms 92, 93. Spring assembly arms 92, 93 extend outwardly from the surface of the flange plate member 91 at an angle. Rotatable member 94 includes an opening extending between opposite first and second ends. Pin 95 is adapted to be inserted into the elongated opening of the rotatable member 94. Rotatable member 94 is attached to the rounded ends of the spring arms 92, 93 by fastening opposite ends of the pin 95 to the arms 92, 93 with mechanical fasteners 96, 97.

Figure 15:
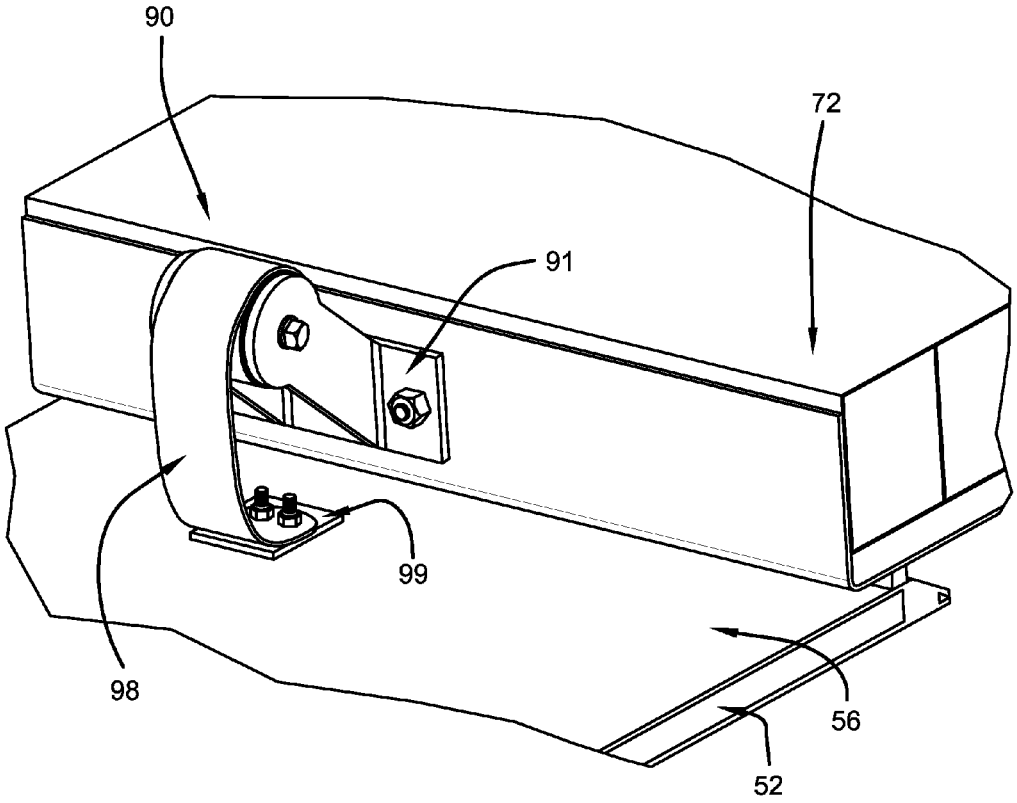
FIG. 15 is a bottom perspective view of the cover panel expansion joint system with a spring assembly attached to a structural member.

FIG. 15 shows spring assembly 90 attached to a side wall of structural member 72. Spring assembly 90 is attached to the structural member 72 by fastening base plate member 91 of the spring assembly 90 to the side wall of the structural member with mechanical fasteners. An end of coil spring 98 is wrapped about at least a portion of the outer circumference of rotatable member 94 of assembly 90. The opposite end of the coil spring 98 is attached to the underside 56 of coverall panel 52 through plate member 99 and mechanical fasteners. The mechanical fasteners are passed through the thickness of cover panel 52, plate member 99 and coil spring 98 to fasten spring 98 to cover panel 52. Coil spring 98 may comprise a constant force spring.

Figure 16:
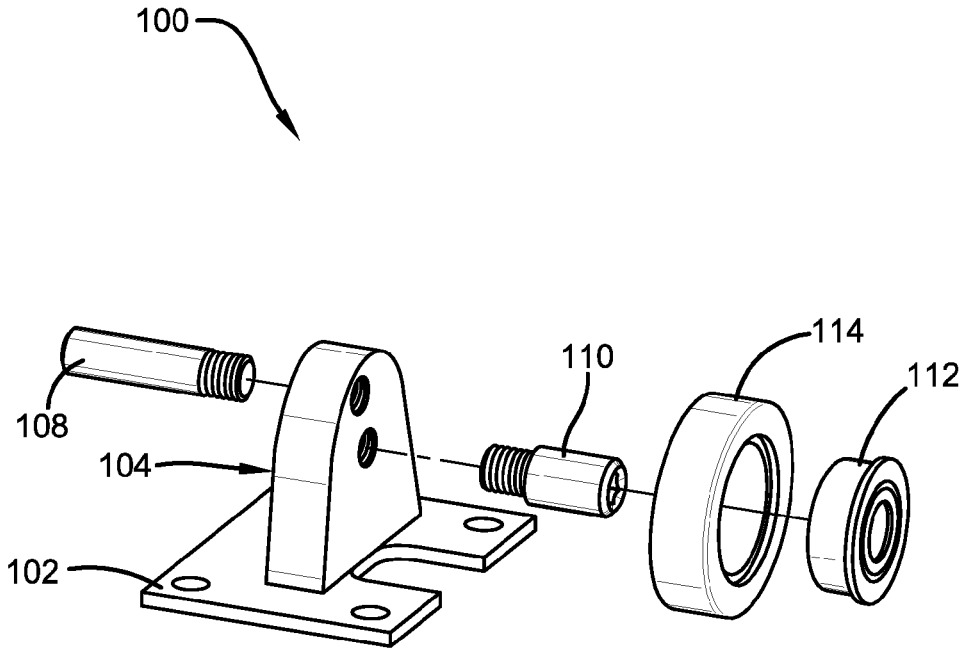
FIG. 16 is an exploded view of an illustrative rider assembly.

FIG. 16 depicts rider assembly 100. Rider 100 includes a base member 102 for attaching rider 100 to the cover panel 52. Extending from base member 102 in a substantially perpendicular manner is vertical mounting 104. Pin 108 is threaded on one side of vertical mount 104 into a cooperating threaded opening. Guide pin 110 is threaded into a cooperating threaded opening on the side of vertical mount that is opposite to the side where pin 108 is threaded. Bearing member 112 is inserted into the central opening of rotatable wheel 114. Bearing member 112 and wheel 114 are fitted over an end portion of pin 110 to connect the rotatable wheel 114 to mounting 104.

The structure of the rider 100 permits rotatable wheel 114 to ride along the slide track 63 of the slide support 60 in response to the opening and closing of the expansion joint. Pin 108 prevents the raising of the cover panel 52 while it is in the neutral position. The pin 108 locks the cover panel 52 in proper position during normal operation of the system, but will unlock as the rider 100 moves back-and-forth along the slide track 63 of the slide support 60. As the expansion joint opens, the wheel 114 slides along track 63 of slide support 60 toward and up the lift component 66 and the guide pin 108 disengages from protrusion 69, which results in the cover panel 52 at least partially opening.

When the expansion joint closes, the wheel 114 of the rider assembly 100 slides on track 63 of the slide support 60 in a direction away from the lift component 66. The guide pin 108 engages with the protrusion 69 of the slide support 66 to mechanically latch or lock the cover panel 52 in position.

Figure 17:
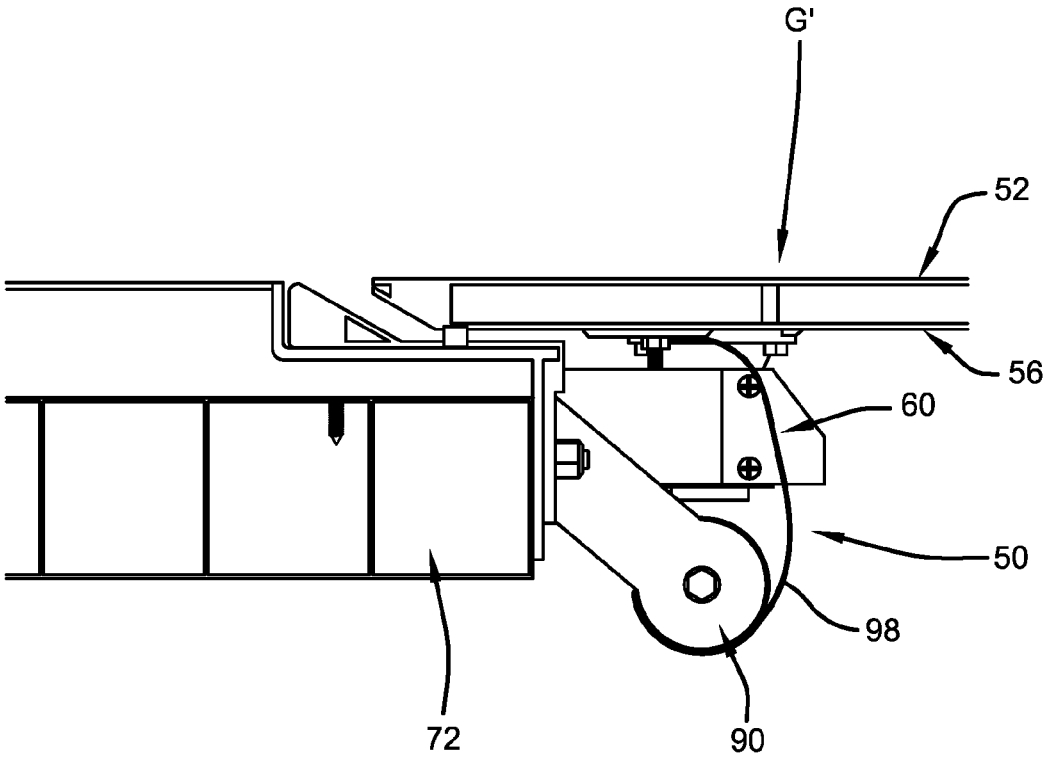
FIG. 17 is partial side view of the cover panel expansion joint assembly positioned within an expansion joint gap.

FIG. 17 shows cover panel expansion joint assembly 50 positioned within an expansion joint gap G'. Assembly 50 includes a slide support 60 that is attached to structural member 72 and extending horizontally into gap G'. Spring assembly 90 is also attached to structural member 72. Spring assembly 90 extends downwardly into gap G' at an angle relative to the horizontally extending slide support 60. The coil spring 98 of the spring assembly 90 is showed engaged with the rotatable member 94 of the assembly 90 and attached to the underside 56 of the cover panel 52.

The present expansion joint system has been described in an illustrative manner, and it is to be understood that the terminology which has been used is intended for the purpose of description rather than of limitation. Many modifications and variations of the present invention are possible in light of the above teachings. It is, therefore, to be understood that within the scope of the appended claims, the present invention may be practiced other than as specifically described.

The invention claimed is:

1. An expansion joint system comprising a cover assembly installed at an expansion gap between a first structural member on one side of said expansion gap and a second structural member on the opposite side of said expansion gap, said cover assembly comprising a cover panel comprising a top side and an underside, said cover panel bridging said expansion gap;

at least one moveable connector joining one edge of said cover panel to said first structural member;

at least one slide support attached to said second structural member, wherein said at least one slide support comprises a top surface, a bottom surface, spaced-apart side walls, a front end, a rear end, a track extending along the top surface of said slide support from said front end to said rear end of said slide support, said track having a lift component located on said track adjacent to said rear end of said slide support, and a protrusion extending substantially perpendicular from one of said side walls of said slide support and located at a distance from said rear end of said slide support;

a rider assembly attached to said underside of said cover panel for engaging with said slide support, said rider assembly comprising a base, a mounting extending substantially perpendicular to said base, a rotatable wheel mounted on one side of said mounting and a guide extending perpendicular from the opposite side of said mounting to engage said protrusion of said slide support, and at least one slide spring assembly, said slide spring assembly comprising a spring plate connected to said second structural member, at least one arm extending outwardly from said spring plate into said expansion gap, a rotatable member engaged with said at least one arm, and a spring having opposite ends, wherein one end of said spring is engaged with said rotatable member and the opposite end of said spring is engaged with said cover panel.

2. The expansion joint system of claim 1 wherein the slide spring assembly comprises a spring plate connected to said second structural member, two spaced-apart arms extending outwardly from said spring plate into said expansion gap, a rotatable member engaged with said arms, and a spring having opposite ends, wherein one end of said spring is engaged with said rotatable member and the opposite end of said spring is engaged with said cover panel.

3. The expansion joint cover assembly of claim 2 wherein the slide spring assembly comprises a spring plate connected to said second structural member, two spaced-apart arms extending outwardly and downwardly from said spring plate into said expansion gap, a rotatable member engaged with said arms, and a spring having opposite ends, wherein one end of said spring is engaged with said rotatable member and the opposite end of said spring is engaged with said cover panel.

4. The expansion joint system of claim 3 wherein said rotatable member comprises a rotatable drum.

5. The expansion joint cover assembly of claim 1 wherein one slide support and rider assembly are flanked by one spring assembly.

6. The expansion joint cover assembly of claim 1 wherein said at least one slide support is connected to an angle bracket, and said angle bracket is connected to said second structural member.

7. The expansion joint cover assembly of claim 6 wherein said slide support is moveably engaged with said rider assembly.

8. The expansion joint cover assembly of claim 7 wherein said rider assembly comprises a base, a mounting extending substantially perpendicular to said base, rotatable wheel mounted on one side of said mounting and a pin extending perpendicular from the opposite side of said mounting to engage said protrusion of said slide support.

9. The expansion joint cover assembly of claim 1 wherein said expansion cover panel includes a groove of a determined length and width formed in the underside of said cover panel.

10. The expansion joint cover assembly of claim 9 further comprising an groove angle bracket having a width less than the groove in said cover panel and slidable within said groove of said cover panel.

11. The expansion joint assembly of claim 10 wherein said angle bracket is selected from at least of a two-membered bracket, the members being orthogonal to each other, and a three membered bracket which is a right angle isosceles triangle.

12. The expansion joint cover assembly of claim 1 wherein said at least one movable connector is a pivoting connector.

13. The expansion joint cover assembly of claim 12 wherein said pivoting connector is a hinge.

14. The expansion joint cover assembly of claim 1 wherein said assembly is a seismic expansion joint cover assembly.

15. An expansion joint system comprising spaced-apart first and second structural members; and a cover assembly installed at an expansion gap between said first structural member on one side of said expansion gap and said second structural member on the opposite side of said expansion gap, said cover assembly comprising a cover panel comprising a top side and an underside, said cover panel bridging said expansion gap;

at least one moveable connector joining one edge of said cover panel to said first structural member;

at least one slide support attached to said second structural member, wherein said at least one slide support comprises a top surface, a bottom surface, spaced-apart side walls, a front end, a rear end, a track extending along the top surface of said slide support from said front end to said rear end of said slide support, said track having a lift component located on said track adjacent to said rear end of said slide support, and a protrusion extending substantially perpendicular from one of said side walls of said slide support and located at a distance from said rear end of said slide support;

a rider assembly attached to said underside of said cover panel for engaging with said slide support, said rider assembly comprising a base, a mounting extending substantially perpendicular to said base, a rotatable wheel mounted on one side of said mounting and a guide extending perpendicular from the opposite side of said mounting to engage said protrusion of said slide support, and at least one slide spring assembly, said slide spring assembly comprising a spring plate connected to said second structural member, at least one arm extending outwardly from said spring plate into said expansion gap, a rotatable member engaged with said at least one arm, and a spring having opposite ends, wherein one end of said spring is engaged with said rotatable member and the opposite end of said spring is engaged with said cover panel.

16. A vertical wall comprising:

spaced-apart, vertically extending first and second structural members having an expansion gap between said first and second structural members; and an expansion joint cover assembly installed at said expansion gap between said first structural member on one side of said expansion gap and said second structural member on the opposite side of said expansion gap, said cover assembly comprising a cover panel comprising a top side and an underside, said cover panel bridging said expansion gap;

at least one moveable connector joining one edge of said cover panel to said first structural member;

at least one slide support attached to said second structural member, wherein said at least one slide support comprises a top surface, a bottom surface, spaced-apart side walls, a front end, a rear end, a track extending along the top surface of said slide support from said front end to said rear end of said slide support, said track having a lift component located on said track adjacent to said rear end of said slide support, and a protrusion extending substantially perpendicular from one of said side walls of said slide support and located at a distance from said rear end of said slide support;

a rider assembly attached to said underside of said cover panel for engaging with said slide support, said rider assembly comprising a base, a mounting extending substantially perpendicular to said base, a rotatable wheel mounted on one side of said mounting and a guide extending perpendicular from the opposite side of said mounting to engage said protrusion of said slide support, and at least one slide spring assembly, said slide spring assembly comprising a spring plate connected to said second structural member, at least one arm extending outwardly from said spring plate into said expansion gap, a rotatable member engaged with said at least one arm, and a spring having opposite ends, wherein one end of said spring is engaged with said rotatable member and the opposite end of said spring is engaged with said cover panel.

* * * * *